US006484996B2

(12) United States Patent
Astell

(10) Patent No.: US 6,484,996 B2
(45) Date of Patent: Nov. 26, 2002

(54) DEVICE FOR REMOVABLY FASTENING A PICTURE TO A BOARD

(76) Inventor: Benjamin F. Astell, 755 N. Tratt St. #61, Whitenater, WI (US) 53190-2633

( * ) Notice: Subject to any disclaimer, the term of this patent is extended or adjusted under 35 U.S.C. 154(b) by 0 days.

(21) Appl. No.: 09/782,012

(22) Filed: Feb. 13, 2001

(65) Prior Publication Data

US 2001/0038061 A1 Nov. 8, 2001

Related U.S. Application Data

(60) Provisional application No. 60/188,882, filed on Mar. 13, 2000.

(51) Int. Cl.[7] ..... A47G 1/16

(52) U.S. Cl. ..... 248/466; 248/475.1; 248/455; 248/489; 40/757

(58) Field of Search ..... 248/466, 489, 248/475.1, 497, 455, 467; 40/757, 758

(56) References Cited

U.S. PATENT DOCUMENTS 1,675,282 A * 6/1928 Strand
2,742,250 A * 4/1956 Cronberger ..... 248/206
3,729,246 A * 4/1973 Harrell et al. ..... 312/330
3,838,842 A * 10/1974 McCracken ..... 248/476
4,459,773 A * 7/1984 Sandlin et al. ..... 40/155
4,524,939 A * 6/1985 Hogg ..... 248/467
4,837,953 A * 6/1989 Tannenbaum ..... 40/124
5,337,988 A * 8/1994 Kurtz ..... 248/477
5,832,646 A * 11/1998 Albin et al. ..... 40/762
5,960,573 A * 10/1999 Wong ..... 40/757

* cited by examiner

*Primary Examiner*—Leslie A. Braun
*Assistant Examiner*—Steven Marsh
(74) *Attorney, Agent, or Firm*—David J. Archer.

(57) ABSTRACT

A device for removably fastening a picture to a board or the like is disclosed. The device includes a frame which defines an opening for holding the picture, the frame having a front and a back face, a top and a bottom edge and a first and a second side. A fastener is disposed between the back face of the frame and the board, the fastener having a first and a second end, the first end of the fastener defining a board engaging portion for pressing into the board. The second end of the fastener includes a head which removably cooperates with the back face of the frame. The arrangement is such that in use of the device, when the picture has been inserted into the opening in the frame, the frame is fastened to the board by pressing the board engaging portion of the fastener into the board and fastening the head of the fastener to the back face of the frame.

1 Claim, 10 Drawing Sheets

DEVICE FOR REMOVABLY FASTENING A PICTURE TO A BOARD

This application claims benefit of Provisional application No. 60/188,882 filed Mar. 13, 2000.

BACKGROUND OF THE INVENTION

1. Field of the Invention

The present invention relates to a device for removably fastening a picture to a board. More specifically, the present invention relates to a device for removably fastening a picture to a corkboard or the like.

2. Information Disclosure Statement

Corkboards and pegboards are used for displaying various information and typically are provided for mounting thereon photographs or pictures or drawings.

In the past, users of corkboards and the like have pinned photographs directly onto such boards by inserting pins through the material to be displayed and fastening such material directly to the corkboard. However, quite often, a user will wish to fasten a framed picture or photograph onto a corkboard and this has presented several problems.

Although it is known to include magnets on the back of a picture frame, such frame can only be mounted on a refrigerator or similar metallic mounting and Applicant is unaware of any device that would permit a user to fasten a frame directly onto a corkboard or pegboard.

The present invention provides a unique arrangement in which a frame may be attached to a corkboard or the like by means of a fastener so that the frame with photograph therein is securely yet removably attached to the corkboard or pegboard.

Therefore, it is a primary feature of the present invention to provide a device for removably fastening a picture to a board such as a corkboard or the like that overcomes the problems associated with the prior art arrangements.

Other features of the present invention will be readily apparent to those skilled in the art by a careful consideration of the detailed description of a preferred embodiment of the present invention described herein in conjunction with the annexed drawings.

SUMMARY OF THE INVENTION

The present invention relates to a device for removably fastening a picture to a board or the like. The device includes a frame which defines an opening for holding the picture, the frame having a front and a back face, a top and a bottom edge and a first and a second side. A fastener is disposed between the back face of the frame and the board, the fastener having a first and a second end. The first end of the fastener defines a board engaging portion for pressing into the board. The second end of the fastener includes a head which removably cooperates with the back face of the frame. The arrangement is such that in use of the device, when the picture has been inserted into the opening in the frame, the frame is fastened to the board by pressing the board engaging portion of the fastener into the board and fastening the head of the fastener to the back face of the frame.

In a more specific embodiment of the present invention, the frame is of rectangular configuration and the opening is also of rectangular configuration. Furthermore, the frame is of translucent plastic construction.

The device for removably fastening in one embodiment of the present invention includes a magnetic plate which is secured to the back face of the frame. Also, the head of the fastener includes a metallic block which is magnetically attracted to the magnetic plate so that the frame is fastened to the board.

Additionally, in another embodiment of the present invention, the device includes an elongate rail having a first and a second extremity, the rail being secured to the back face of the frame. The rail defines a channel for the slidable captive reception therein of the head of the fastener. The arrangement is such that when the head of the fastener is captured within the channel, the frame is fastened to the board by inserting the board engaging portion of the fastener into the board.

In another embodiment of the present invention, a further fastener is provided which defines a further board engaging portion. Also, the further fastener includes a further head. A further elongate rail is provided which has a further first and a second extremity. The further rail is secured to the back face of the frame and the further rail defines a further channel for the slidable captive reception therein of the further head of the further fastener. The arrangement is such that when the further head of the further fastener is captured within the further channel, the frame is fastened to the board by inserting the further board engaging portion of the further fastener into the board.

Preferably, the rail is disposed adjacent to the top edge of the frame and the further rail is disposed adjacent to the bottom edge of the frame.

Additionally, a first and a second stop are disposed adjacent to the first and second extremity of the rail for preventing the fastener from sliding out of the channel. Also, a further first and a second stop are disposed adjacent to the first and second extremity of the further rail for preventing the further fastener from sliding out of the further channel. The first and second stops of the channel and further channel are preferably rubber caps.

In one embodiment of the present invention, the rail and the further rail are permanently secured to the back face of the frame.

Alternatively, the rail and the further rail are secured to the back face of the frame by adhesive.

Also, in another embodiment of the present invention, the rail defines a first and a second hole so that fastening of the rail to a wooden frame by screws or the like is facilitated.

In one embodiment of the present invention, the fastener includes a shank of rectangular cross sectional configuration, the shank being offset relative to the head for permitting the support of a relatively heavy frame and for preventing rotation of the fastener relative to the rail.

Also, in yet another embodiment of the present invention, a plate of circular configuration is pivotally secured to the back surface of the frame by a spindle. Additionally, fasteners extend through the plate so that when the fasteners are pressed into the board, the plate is fastened to the board and the frame is rotatably secured to the plate.

In one arrangement, the fastener is a pin in which the first end defines a point, the point removably cooperating with the board which is a corkboard.

Alternatively, the fastener is a peg in which the first end removably cooperates with the board which is a pegboard.

Many modifications and variations of the present invention will be readily apparent to those skilled in the art by a consideration of the detailed description contained hereinafter taken in conjunction with the annexed drawings which show a preferred embodiment of the present invention.

However, such modifications and variations fall within the spirit and scope of the present invention as defined by the appended claims.

BRIEF DESCRIPTION OF THE DRAWINGS

Similar reference characters refer to similar parts throughout the various views and embodiments of the present invention shown in the annexed drawings.

DETAILED DESCRIPTION OF THE DRAWINGS

Figure 1:
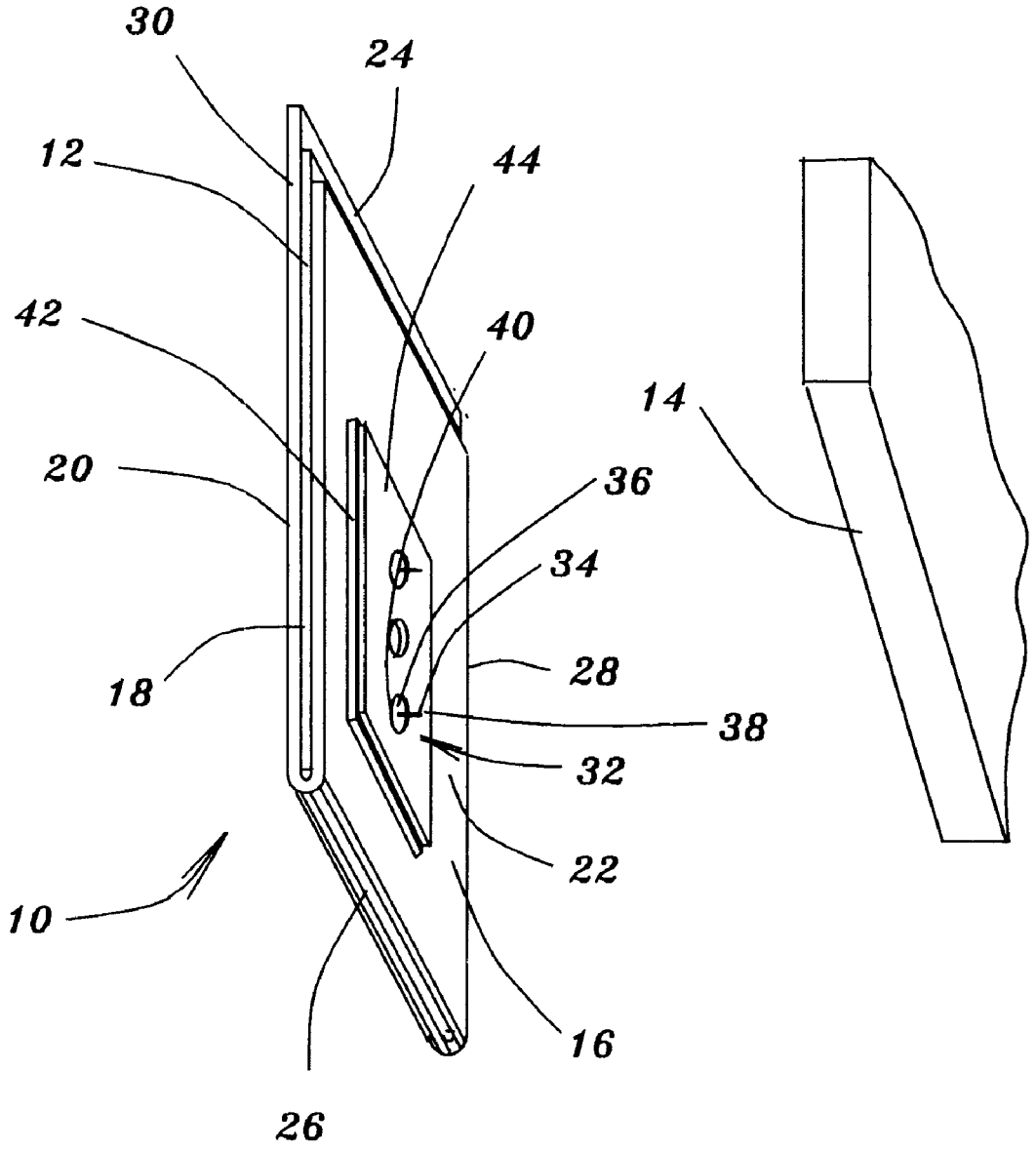
FIG. 1. is a perspective view of a device for removably fastening a picture to a board.

FIG. 1 is a perspective view of a device generally designated 10 for removably fastening a picture 12 to a board 14. As shown in FIG. 1 the device 10 includes a frame 16 which defines an opening 18 for holding the picture 12. The frame 16 has a front and a back face 20 and 22 respectively, a top and a bottom edge 24 and 26 respectively and a first and a second side 28 and 30 respectively. A fastener generally designated 32 is disposed between the back face 22 of the frame 16 and the board 14, the fastener 32 having a first and a second end 34 and 36 respectively. The first end 34 of the fastener 32 defines a board engaging portion 38 for pressing into the board 14. The second end 36 of the fastener 32 includes a head 40 which removably cooperates with the back face 22 of the frame 16. The arrangement is such that in use of the device 10, when the picture 12 has been inserted into the opening 18 in the frame 16, the frame 16 is fastened to the board 14 by pressing the board engaging portion 38 of the fastener 32 into the board 14 and subsequently fastening the head 40 of the fastener 32 to the back face 22 of the frame 16.

In a more specific embodiment of the present invention, the frame 16 is of rectangular configuration and the opening 18 is also of rectangular configuration. Furthermore, the frame 16 is of translucent plastic material.

The device 10, in one embodiment of the present invention includes a magnetic plate 42 which is secured to the back face 22 of the frame 16. Also, the head 40 of the fastener 32 includes a metallic block 44 which is magnetically attracted to the magnetic plate 42 so that the frame 16 is fastened to the board 14.

Figure 2:
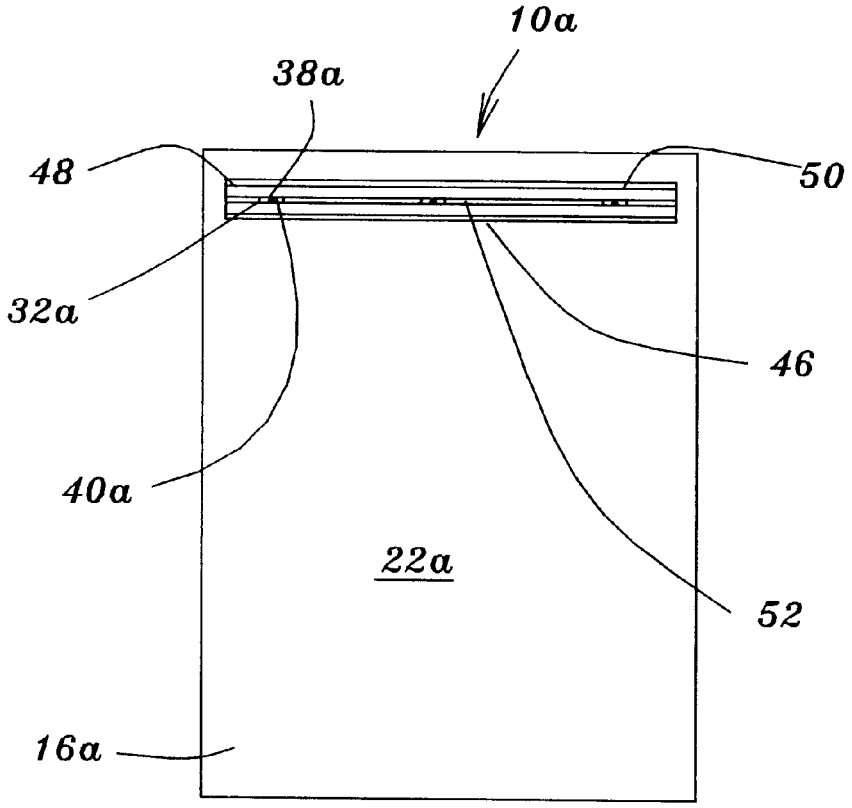
FIG. 2 is a back elevational view of a device for removably fastening a picture to a board according to another embodiment of the present invention.

FIG. 2 is a back elevational view of a device 10*a* for removably fastening a picture to a board according to another embodiment of the present invention. As shown in FIG. 2, the device 10*a* includes an elongate rail 46 having a first and a second extremity 48 and 50 respectively, the rail 46 being secured to the back face 22*a* of the frame 16*a*. The rail 46 defines a channel 52 for the slidable captive reception therein of a head 40*a* of a fastener 32*a*. The arrangement is such that when the head 40*a* of the fastener 32*a* is captured within the channel 52, the frame 16*a* is fastened to the board (not shown) by inserting a board engaging portion 38*a* of the fastener 32*a* into the board.

Figure 3:
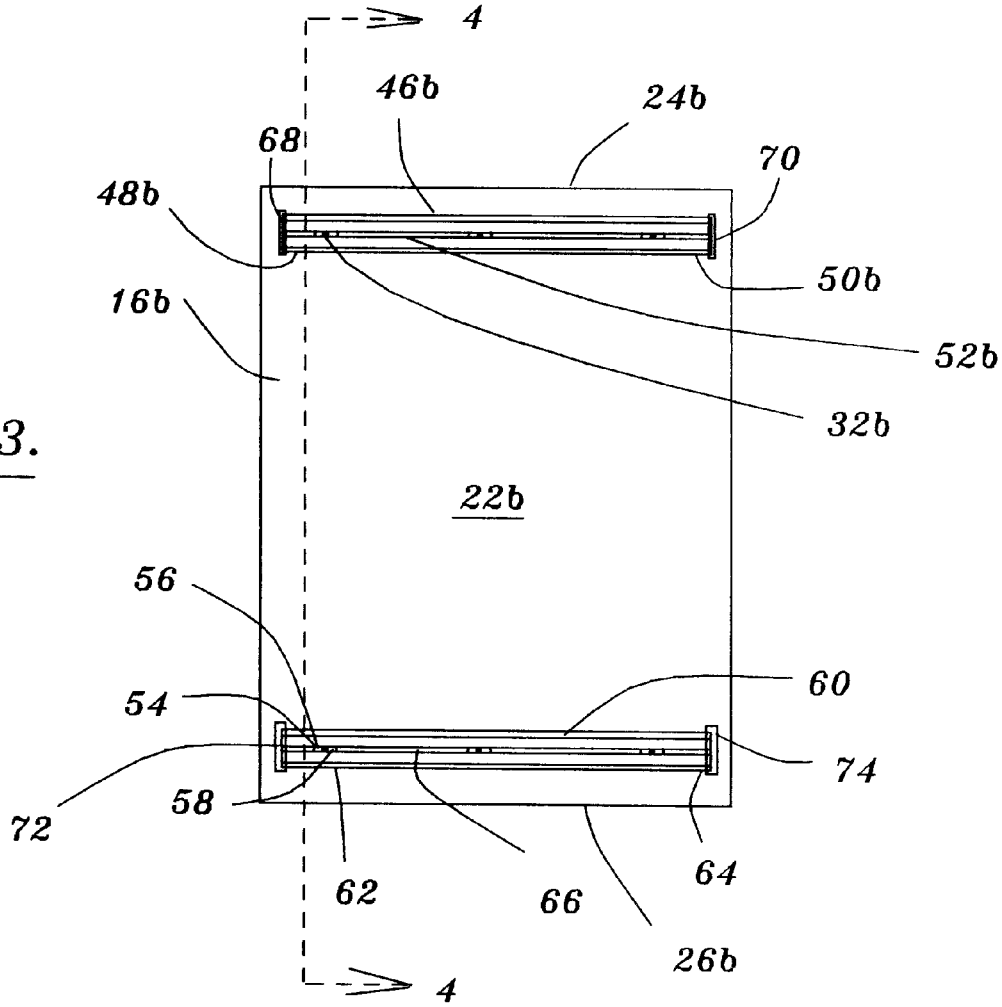
FIG. 3 is a similar view to that shown in FIG. 2 but shows another embodiment of the present invention.

FIG. 3 is a similar view to that shown in FIG. 2 but shows another embodiment of the present invention. As shown in FIG. 3, a further fastener generally designated 54 is provided which defines a further board engaging portion 56. Also, the further fastener 54 includes a further head 58. A further elongate rail 60 is provided which has a further first and a second extremity 62 and 64 respectively. The further rail 60 is secured to a back face 22*b* of a frame 16*b* and the further rail 60 defines a further channel 66 for the slidable captive reception therein of the further head 58 of the further fastener 54. The arrangement is such that when the further head 58 of the further fastener 54 is captured within the further channel 66, the frame 16*b* is fastened to a board 14*b* by inserting the further board engaging portion 56 of the further fastener 54 into the board 14*b*.

Preferably, the rail 46*b* is disposed adjacent to the top edge 24*b* of the frame 16*b* and the further rail 60 is disposed adjacent to the bottom edge 26*b* of the frame 16*b*.

Additionally, a first and a second stop 68 and 70 respectively, are disposed adjacent to the first and second extremity 48*b* and 50*b* respectively of the rail 46*b* for preventing the fastener 32*b* from sliding out of the channel 52*b*. Also, a further first and a second stop 72 and 74 respectively are disposed adjacent to the first and second extremity 62 and 64 respectively of the further rail 60 for preventing the further fastener 54 from sliding out of the further channel 66. The first and second stops 68, 70 and 72, 74 of the channel 52b and further channel 66 are preferably rubber caps.

Figure 4:
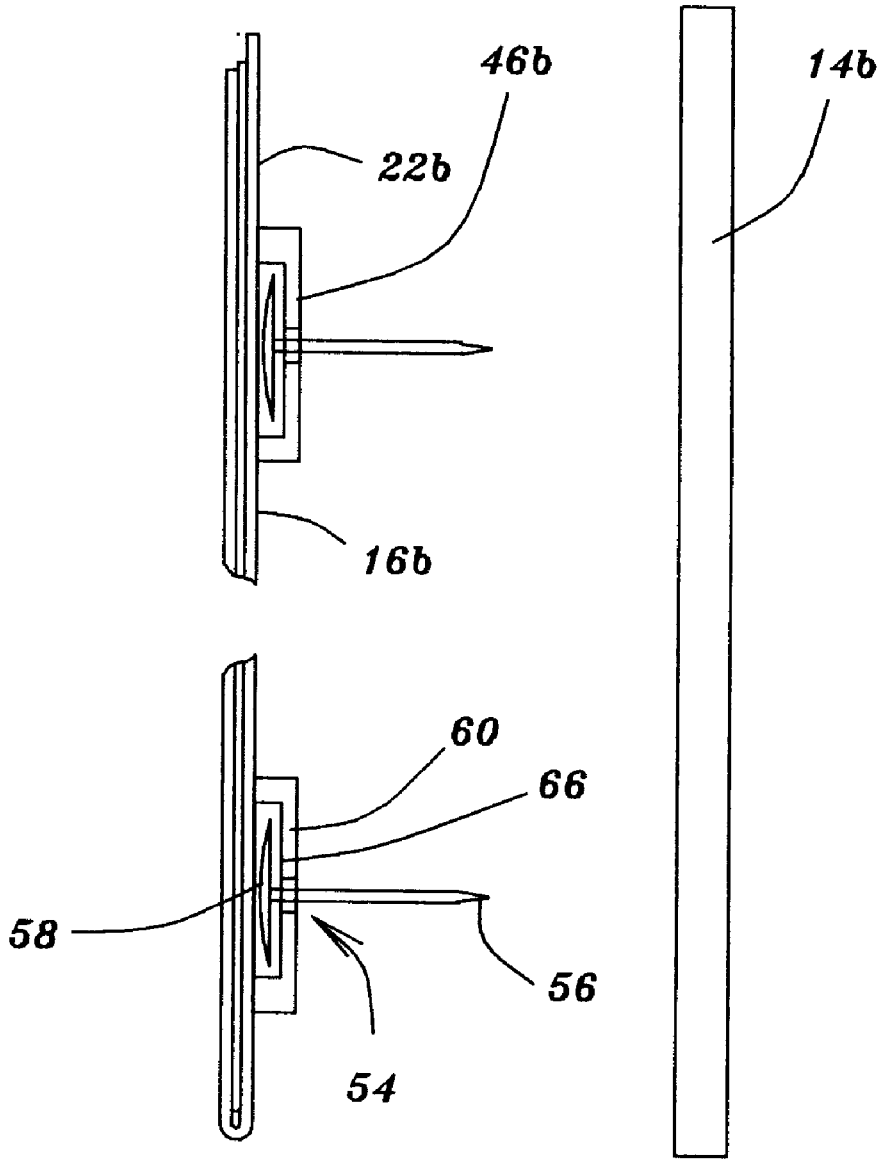
FIG. 4 is an enlarged fragmentary view taken on the line 4—4 of FIG. 3.

FIG. 4 is an enlarged fragmentary view taken on the line 4—4 of FIG. 3. As shown in FIG. 4, the rail and the further rail 46*b* and 60 respectively are permanently secured to the back face 22*b* of the frame 16*b*.

Figure 5:
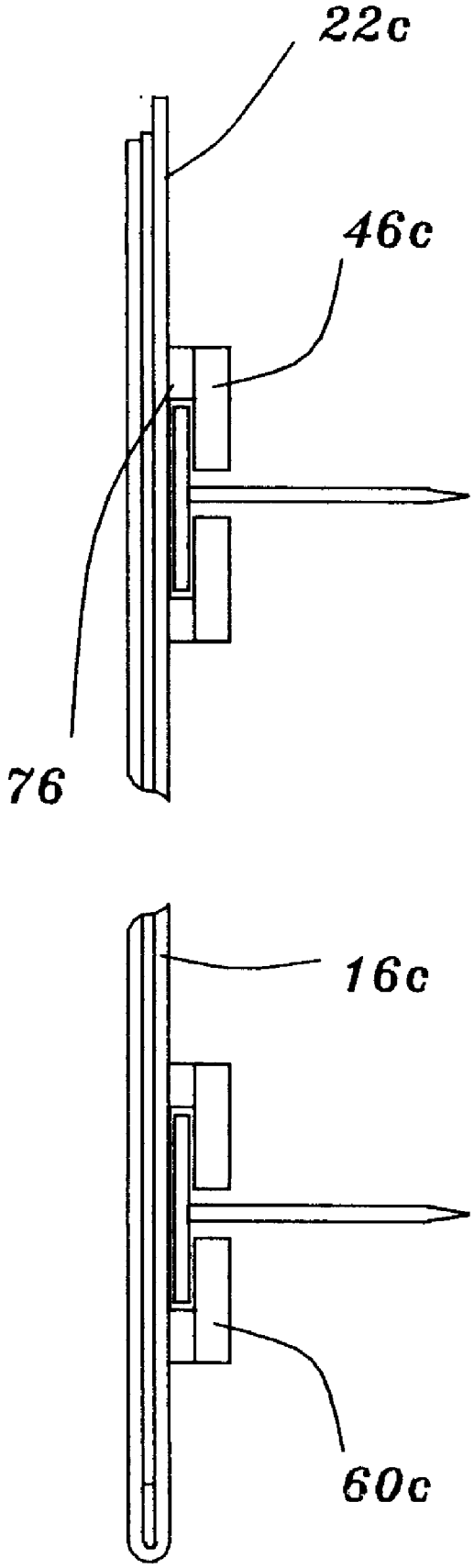
FIG. 5 is a similar view to that shown in FIG. 4 but shows yet another embodiment of the present invention.

FIG. 5 is a similar view to that shown in FIG. 4 but shows yet another embodiment of the present invention. As shown in FIG. 5, the rail and the further rail 46*c* and 60*c* are secured to the back face 22*c* of the frame 16*c* by adhesive 76.

Figure 6:
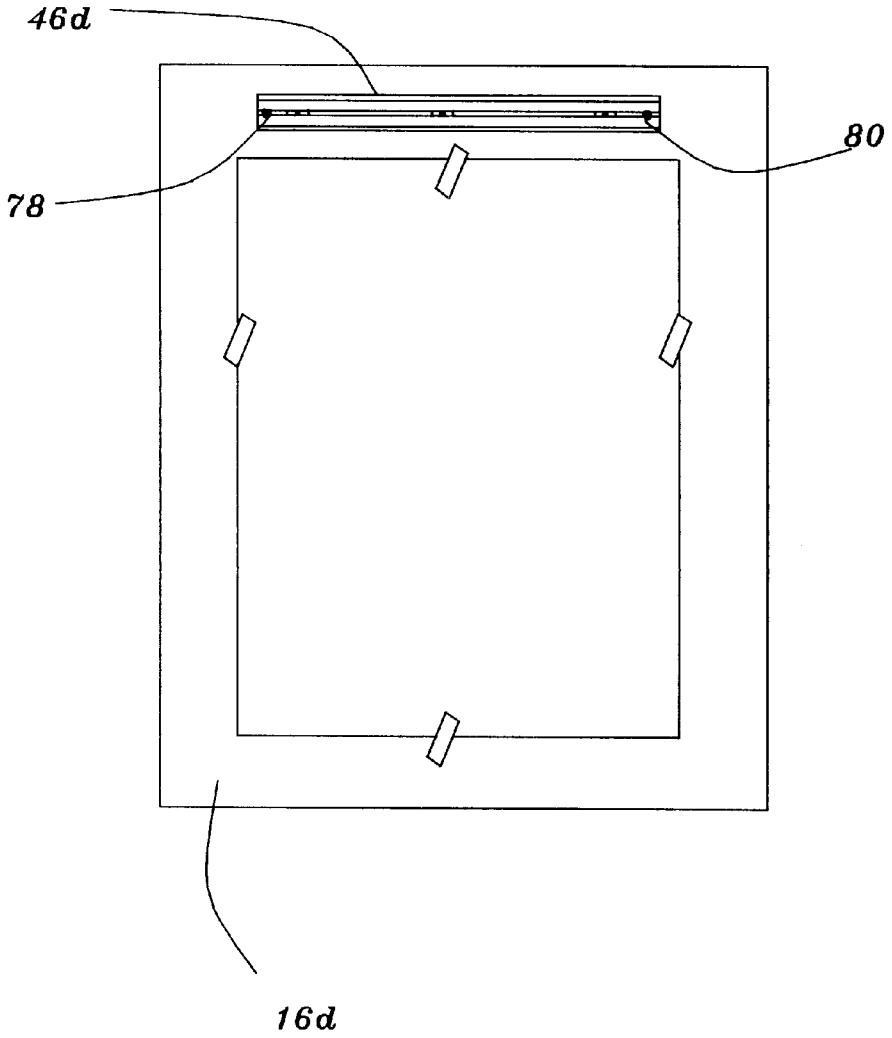
FIG. 6 is a similar view to that shown in FIG. 2 but shows another embodiment of the present invention as applied to a wooden frame.

FIG. 6 is a similar view to that shown in FIG. 2 but shows another embodiment of the present invention as applied to a wooden frame 16*d*. As shown in FIG. 6 the rail 46*d* defines a first and a second hole 78 and 80 respectively so that fastening by screws or the like of the rail 46*d* to the wooden frame 16*d* is facilitated.

Figure 7:
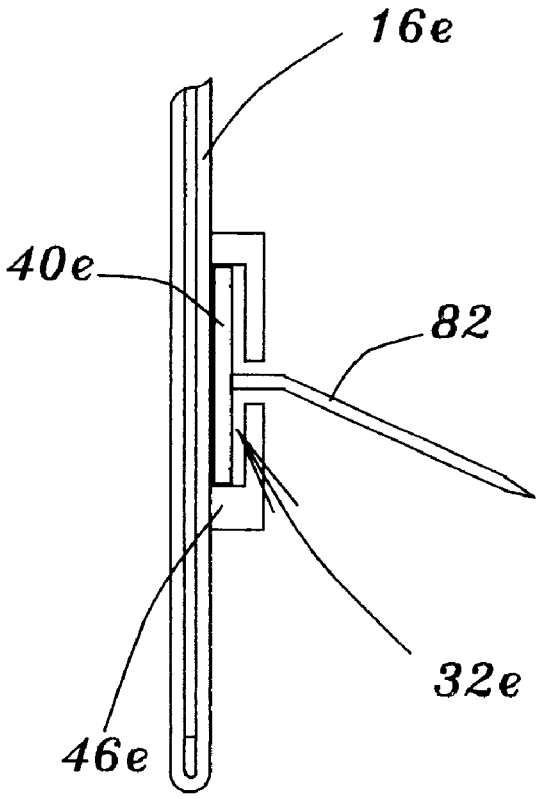
FIG. 7 is a similar view to that shown in FIG. 4 but shows still another embodiment of the present invention.

FIG. 7 is a similar view to that shown in FIG. 4 but shows still another embodiment of the present invention. As shown in FIG. 7, the fastener generally designated 32*e* includes a shank 82 of rectangular cross sectional configuration, the shank 82 being offset relative to the head 40*e* for permitting the support of a relatively heavy frame 16*e* and for preventing rotation of the fastener 32*e* relative to the rail 46*e*.

Figure 8:
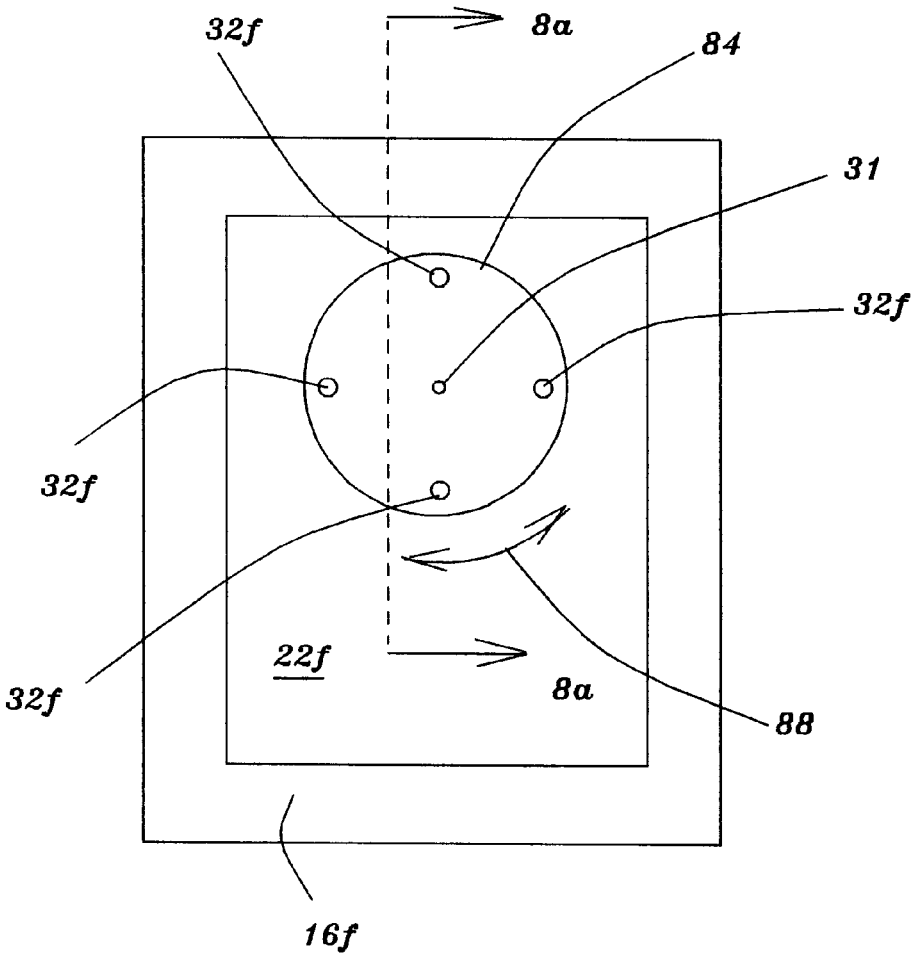
FIG. 8 is a view that is similar to that shown in FIG. 6 but shows another embodiment of the present invention which includes a circular plate.

FIG. 8 is a view that is similar to that shown in FIG. 6 but shows another embodiment of the present invention which includes a circular plate 84. As shown in FIG. 8, the plate 84 of circular configuration is secured to the back surface 22*f* of the frame 16*f* by means of a spindle 31. Additionally, four fasteners 32*f* disposed adjacent to the periphery of the plate

84 extend through the plate 84 so that when the fasteners 32*f* are pressed into a board 14*f*, the plate 84 is fastened to the board 14*f* and the frame 16*f* is rotatably secured to the plate 84 as indicated by the arrow 88.

Figure 8A:
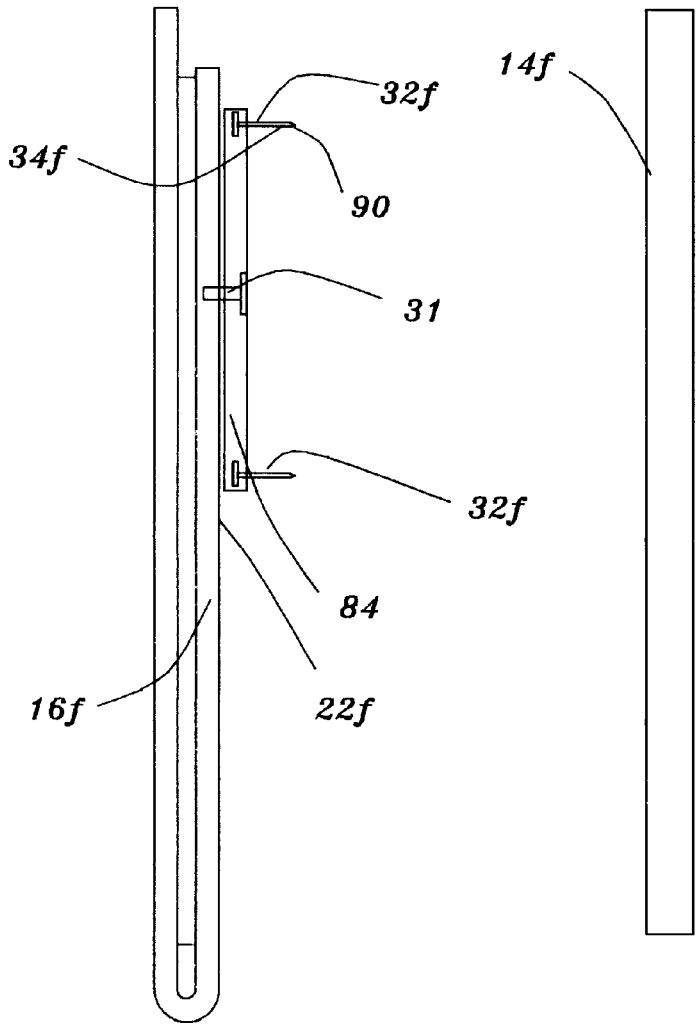
FIG. 8*a* is a view taken on the line 8*a*—8*a* of FIG. 8.

FIG. 8*a* is a sectional view taken on the line 8*a*—8*a* of FIG. 8. As shown in FIG. 8*a*, the fasteners 32*f* are four pins disposed adjacent to the periphery of the plate 84. Each of the pins 32*f* has a first end 34*f* thereof which defines a point 90, the point 90 removably cooperating with the board 14*f* which is a corkboard.

The frame 16*f* is of plastic material or material having enough strength to support stress between a wooden or metal backing 22*f* of the frame 16*f* and the plate 84. Also, the spindle 31 is merely a pivoting pin having a head which is set flush with or below the surface of the plate 84.

Figure 9:
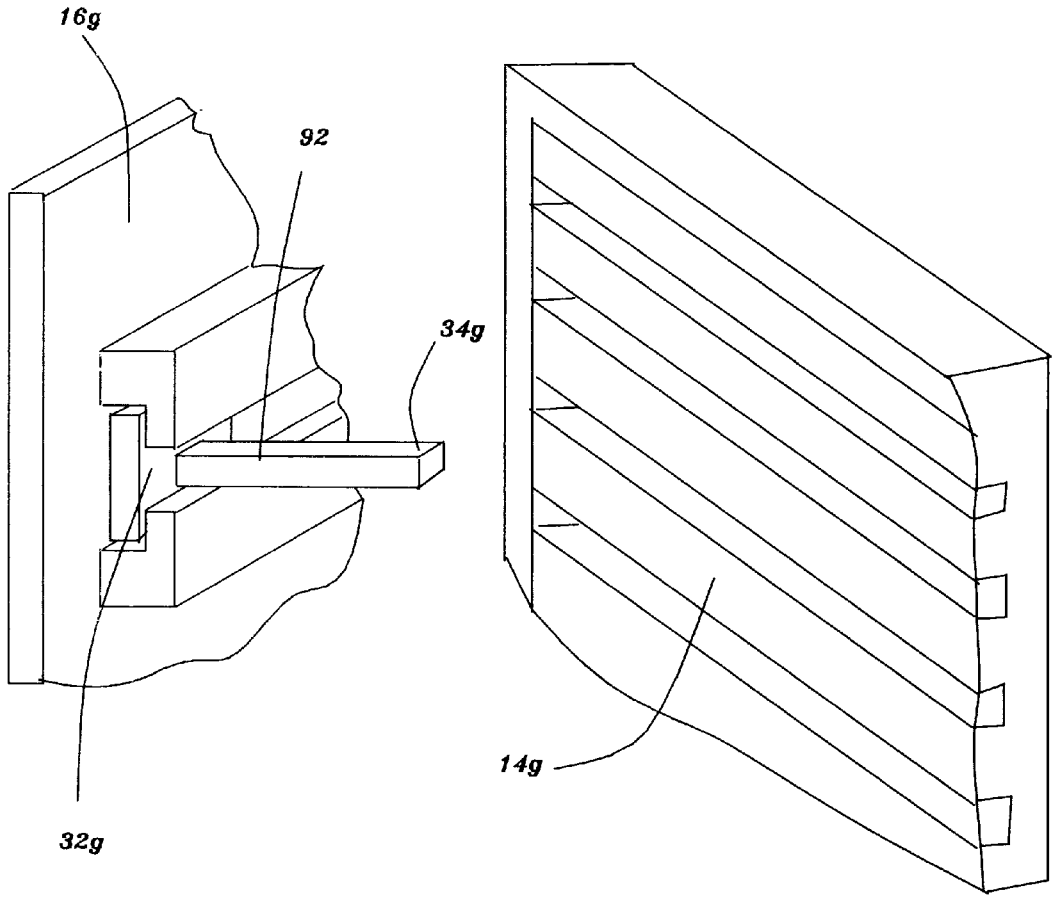
FIG. 9 is a perspective view of a device for removably fastening a picture to a pegboard.

FIG. 9 is a perspective view of a device for removably fastening a picture to a pegboard. As shown in FIG. 9, the fastener 32*g* is a peg 92 in which the first end 34*g* removably cooperates with the board 14*g* which is a pegboard.

The present invention provides a unique arrangement for removably fastening a picture or photograph to a corkboard or a pegboard so that the picture can be correctly aligned relative to the board without having to insert pins or the like through the picture.

What is claimed is:

1. A device for removably fastening a picture to a board, said device comprising:

a frame defining an opening for holding the picture, said frame having a front and a back face, a top and a bottom edge and a first and a second side;

a fastener disposed between said back face of said frame and the board;

said fastener having a first and a second end, said first end of said fastener defining a board engaging portion for pressing into said board;

said second end of said fastener including:

a head which removably cooperates with said back face of said frame, the arrangement being such that in use of said device, when the picture has been inserted into said opening in said frame, said frame is fastened to the board by pressing said board engaging portion of said fastener into the board and fastening said head of said fastener to said back face of said frame;

said frame being of rectangular configuration;

said opening being of rectangular configuration;

said frame being of translucent plastic construction;

an elongate rail having a first and a second extremity, said rail being secured to said back face of said frame, said rail defining a channel for the slidable captive reception therein of said head of said fastener, the arrangement being such that when said head of said fastener is captured within said channel, said frame is fastened to the board by inserting said board engaging portion of said fastener into the board;

a further fastener defining a further board engaging portion;

said further fastener including:

a further head;

a further elongate rail having a further first and a second extremity, said further rail being secured to said back face of said frame, said further rail defining a further channel for the slidable captive reception therein of said further head of said further fastener, the arrangement being such that when said further head of said further fastener is captured within said further channel, said frame is fastened to said board by inserting said further board engaging portion of said further fastener into the board;

said rail being disposed adjacent to said top edge of said frame;

said further rail being disposed adjacent to said bottom edge of said frame;

a first and a second stop disposed adjacent to said first and second extremity of said rail for preventing said fastener from sliding out of said channel;

a further first and a second stop disposed adjacent to said first and second extremity of said further rail for preventing said further fastener from sliding out of said further channel;

said first and second stops of said channel and further channel being rubber caps;

said rail and said further rail being permanently secured to said back face of said frame;

said rail and said further rail being secured to said back face of said frame by adhesive;

said fastener further including:

a shank of rectangular cross sectional configuration, said shank being offset relative to said head for permitting the support of a relatively heavy frame and for preventing rotation of said fastener relative to said rail; and said fastener being a pin in which said first end thereof defines a point, said point removably cooperating with the board which is a corkboard.

* * * * *